US005606221A

United States Patent [19]

Sobieradzki et al.

[11] Patent Number: 5,606,221

[45] Date of Patent: Feb. 25, 1997

[54] ELECTRON BEAM TUBES HAVING A RESONANT CAVITY WITH HIGH FREQUENCY ABSORBING MATERIAL

[75] Inventors: Edward S. Sobieradzki, Chelmsford; Steven Bardell, Barnston, both of United Kingdom

[73] Assignee: EEV Limited, United Kingdom

[21] Appl. No.: 261,767

[22] Filed: Jun. 17, 1994

[30] Foreign Application Priority Data

Jun. 28, 1993 [GB] United Kingdom ..... 9313265

[51] Int. Cl.[6] ..... H01J 23/54

[52] U.S. Cl. ..... 315/5; 315/5.33; 315/5.37; 330/45; 333/81 R

[58] Field of Search ..... 315/4, 5, 5.33, 315/5.37, 5.39, 39; 330/44, 45; 333/81 R, 251

[56] References Cited

U.S. PATENT DOCUMENTS

| | | | |
|---|---|---|---|
| 3,381,163 | 4/1968 | La Rue et al. | 315/5.39 |
| 4,163,175 | 7/1979 | Tashiro | 315/39.51 |
| 4,174,492 | 11/1979 | Holle | 333/251 X |
| 4,529,911 | 7/1985 | Hutter | 315/39 |
| 5,130,206 | 7/1992 | Rajan et al. | 428/552 |
| 5,266,868 | 11/1993 | Sakamoto et al. | 315/5 |

FOREIGN PATENT DOCUMENTS

| | | |
|---|---|---|
| 4107552 | 9/1991 | Germany . |
| 61-039435 | 2/1986 | Japan . |
| 1045537 | 3/1986 | Japan . |
| 2243943 | 11/1991 | United Kingdom . |
| 2244173 | 11/1991 | United Kingdom . |
| 2259708 | 3/1993 | United Kingdom . |

*Primary Examiner*—Benny T. Lee
*Attorney, Agent, or Firm*—Spencer & Frank

[57] ABSTRACT

In an electron beam tube, such as an IOT, ferrite loaded silicone rubber or some other ferrite loaded dielectric material, is carried by a wall of an input cavity. The material absorbs r.f. energy, reducing coupling between different parts of the tube which could otherwise result in undesirable oscillation. Furthermore, its provision on part of the input cavity wall enables easy access to be made for replacement and servicing requirements.

14 Claims, 3 Drawing Sheets

ELECTRON BEAM TUBES HAVING A RESONANT CAVITY WITH HIGH FREQUENCY ABSORBING MATERIAL

FIELD OF THE INVENTION

This invention relates to electron beam tubes and more particularly to input resonator cavities of such tubes at which high frequency energy is applied.

BACKGROUND OF THE INVENTION

The present invention is particularly applicable to inductive output tetrode devices ( hereinafter referred to as "IOT's"). An IOT device includes an electron gun arranged to produce a linear electron beam and a resonant input cavity at which a high frequency r.f. signal to be amplified is applied to produce modulation of the beam at a grid of the electron gun. The resultant interaction between the r.f. energy and the electron beam produces amplification of the high frequency signal which is then extracted from an output resonant cavity.

One known IOT device is schematically illustrated in longitudinal section in FIG. 1. The IOT includes an electron gun 1 which comprises a cathode 2, an anode 3 and a grid 4 located between them. The electron gun is arranged to produce an electron beam directed along the longitudinal axis X—X of the arrangement. The IOT also includes drift tubes 5 and 6 via which the electron beam passes before being collected by a collector (not shown). A cylindrical annular input cavity 7 is arranged coaxially about the electron gun 1 and includes an input coupling 8 at which an r.f. signal to be amplified is applied. An output cavity 9 surrounds the gap between the drift tubes 5 and 6 and includes a coupling loop 10 via which an amplified r.f. signal is extracted and coupled into a secondary output cavity 11 from which the output signal is taken via an output coupling 12.

The input cavity 7 comprises an inner body portion which includes two transversely arranged annular plates 13 and 14. The first plate 13 is connected via conductive spring fingers (not shown) to a tubular member 15 which mechanically supports the cathode 2 and is maintained at cathode potential. The other transverse plate 14 is connected via spring fingers to a support 16 of the grid 4 and is at the grid potential. The input cavity 7 also includes an outer body portion which is electrically separate from the inner body portion and comprises transverse annular plates 17 and 18 connected by a cylindrical axially extensive wall 19 and arranged coextensively with part of the plate 13. The outer body portion also includes further transverse plates 20 and 21 connected by a cylindrical wall 22 which are partially coextensive with the plate 14 which is electrically connected to the grid 4. These two interleaved structures acts as r.f. chokes to reduce leakage of the applied high frequency energy into the region between the grid 4 and anode 3 and to the outside of the cavity 7. The cavity 7 further includes an axially extensive portion 23 having a movable tuning device 24 to permit the frequency of operation to be altered. It also includes a cylindrical wall 25 connected to the plate 21 and being axially extensive in the region between the supports 16 and 26 of the grid 4 and anode 3, respectively.

Dielectric material 27 is located between the interleaved transverse plates of the inner and outer body portions to provide structural support and electrical insulation.

Ceramic cylinders 28 and 29 surround the electron gun assembly and define part of the vacuum envelope.

In use, a d.c. voltage, typically of the order of 30–40 kV is established between the cathode 2 and the anode 3 and an r.f. input signal is applied between the cathode 2 and the grid 4. The r.f. choke defined by plates 14, 20 and 21 reduces coupling between the cathode/grid region and the anode 3. However, in some circumstances this may be insufficient to completely prevent leakage of r.f. energy and coupling between the two regions and, as a result, unwanted oscillation of the electron beam may occur. Such oscillation may not only decrease the operating efficiency of the tube but may also cause arcing within the tube sufficient to damage or disable it.

The present invention seeks to provide an improved electron beam tube in which the problem of unwanted oscillation is reduced or eliminated hence permitting devices to operate at higher maximum operating frequencies. The invention is particularly applicable to IOTs but may also be advantageously employed in other types of electron beam tubes.

SUMMARY OF THE INVENTION

According to the invention there is provided an electron beam tube arrangement comprising an electron gun assembly, a substantially annular high frequency resonant input cavity arranged coaxially about it and material capable of absorbing high frequency energy carried by a wall member defining the input cavity.

By employing the invention, unwanted oscillation may be reduced or eliminated as the material carried by the wall can be arranged so that it tends to absorb energy which might otherwise be coupled between different parts of the tube. In many applications, it is also necessary that the material is capable of holding off a d.c. voltage difference of tens of kilovolts, typically 30–40 kV. A suitable material for use in the invention is a ferrite loaded dielectric material and preferably the dielectric material is silicone rubber. One suitable material loaded with dielectric particles is that designated as Eccosorb CF-S-4180 obtainable from Emerson and Cuming. This ferrite loaded silicone rubber material is a high loss material in the UHF and microwave ranges and is also capable of holding off high dc voltages of the order of several tens of kilovolts.

As the material is carried by a wall defining the cavity, it can be arranged to be readily accessible for replacement, if necessary, or for upgrading an existing tube. The main body of the tube, including sections under vacuum, may be kept in situ as set up for operation and the cavity wall removed for servicing elsewhere, if desired. During servicing, a replacement cavity wall can be fitted to the tube to enable operation to continue substantially uninterrupted whilst the servicing work is carried out separately. Thus, the positioning of the material on the cavity wall gives significant benefits in maintaining the tube in a serviceable condition whilst also enhancing its performance. Advantageously, the material is located in a region of the tube which is not under vacuum.

The high frequency absorbing material is in one advantageous embodiment of the invention carried directly by the wall surface. For example, the wall may be of a cylindrical configuration and the material is attached to its inner surface. In another embodiment of the invention, the absorbing material is supported by an intervening layer of electrically insulating material carried by the wall. The intervening layer may be, for example, resin or an unloaded silicone rubber.

In a particularly advantageous embodiment of the invention, the absorbing material is arranged adjacent to electrically insulating material and the boundary between the two materials is not exposed. For example, the absorbing material may be configured as an annular ring directly carried by the interior surface of a cavity wall and surrounded on all other sides by resin or unloaded rubber. In this case what would otherwise be a surface boundary between the two materials is shielded by the cavity wall. Such an arrangement reduces the likelihood of arcing occurring.

Where an r.f. choke arrangement is included between parts of the input cavity to reduce leakage therefrom, the absorbing material may be included between the coextensive parts of the choke arrangement. Such a choke may be transversely extensive or could extend in an axial direction. The absorbing material may form only part of the insulator between the portions of the choke arrangement at different potentials or substantially the entire amount.

Preferably, the electron gun assembly comprises a cathode and an anode and the absorbing material is located co-axially around the gap between them.

Surfaces of the absorbing material may be made undulating so as to reduce the tendency for arcing and breakdown to occur but in other embodiments it need only be necessary to present a smooth surface.

BRIEF DESCRIPTION OF DRAWINGS

Some ways in which the invention may be performed are now described by way of example with reference to the accompanying drawings in which like reference numerals are used for like parts (note that all like parts are not necessarily described in all figures), and in which like reference.

DESCRIPTION OF PREFERRED EMBODIMENTS

Figure 1:
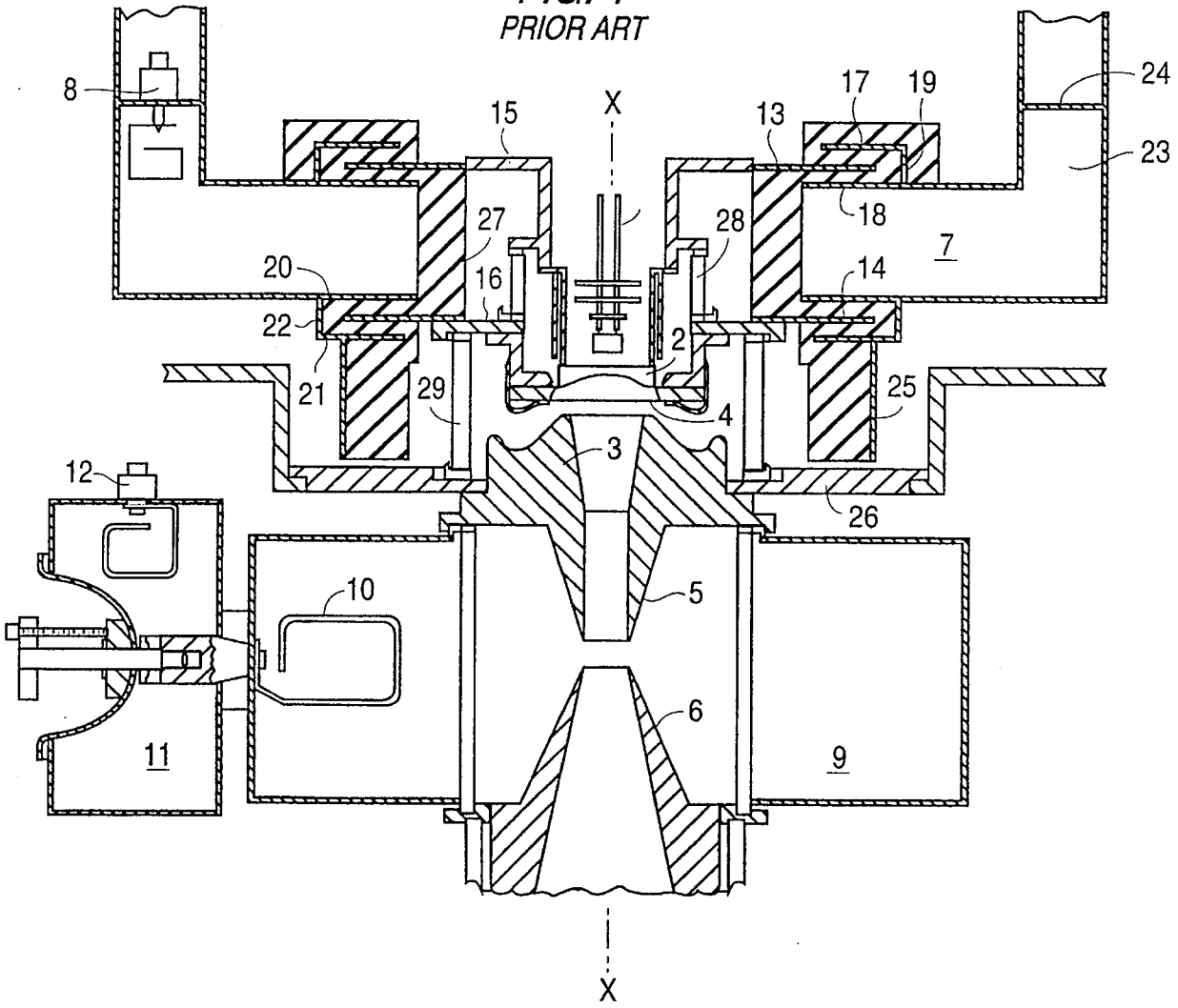
FIG. 1 PRIOR ART
FIG. 1 schematically shows in longitudinal section a prior art IOT arrangement.
Figure 2:
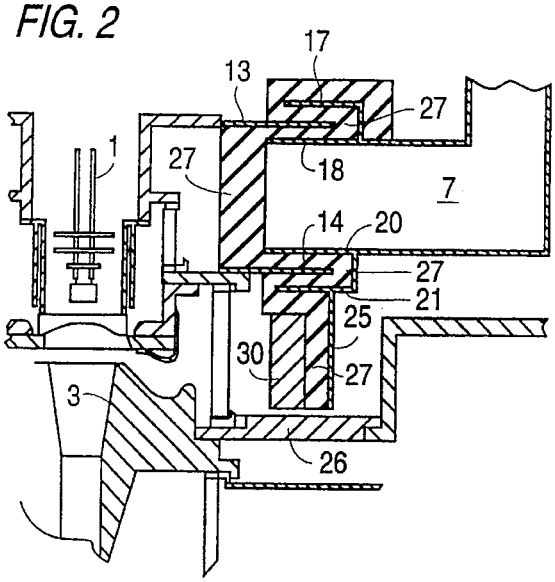
FIG. 2 schematically shows an IOT wherein ferrite loaded silicone rubber is affixed to the surface of a resin.

With reference to FIG. 2, an IOT similar to that shown in FIG. 1 includes an input cavity 7 having inner and outer body portions and r.f. chokes defined by transverse plates 13, 17 and 18 and by plates 14, 20 and 21. In this arrangement, dielectric material 27 is located between the chokes defined by the coextensive parts of the inner and outer body portions of the cavity 7 and in this case the material is a resin. The resin included between the plates 14, 20 and 21 also extends axially towards the anode 3, being supported by a cylindrical wall 25 of the input cavity. A circumferential region of ferrite loaded silicone rubber 30 is mounted on the inner surface of the resin 27 carried by the wall 25 and is partially extensive in the region between the plate 21 and the support 26 of the anode 3. The outer surfaces of the material 30 are substantially smooth but in other arrangements may be undulating to reduce any tendency for arcing to occur.

Figure 3:
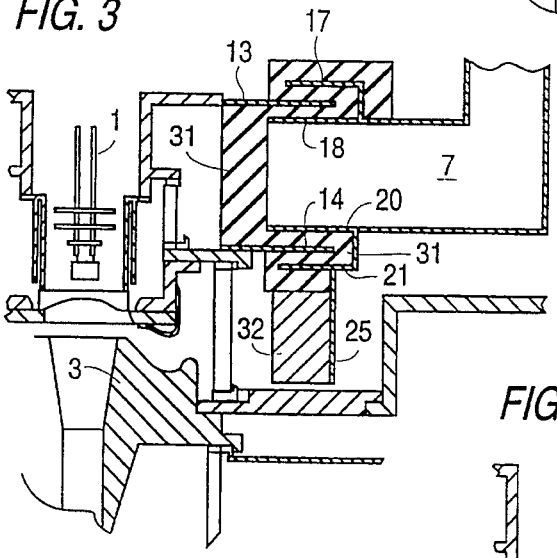
FIG. 3 schematically shows an IOT wherein ferrite loaded silicone rubber is borne directly by a cylindrical wall.

With reference to FIG. 3, in another IOT in accordance with the invention, the dielectric material between the plates 13, 17, 18, and 14, 20, 21 defining chokes is unloaded silicone rubber 31, with no ferrite particles being distributed in it. Ferrite loaded silicone rubber 32 is borne directly by the cylindrical wall 25 of the input cavity 7 and adjoins the silicone rubber 31.

Figure 4:
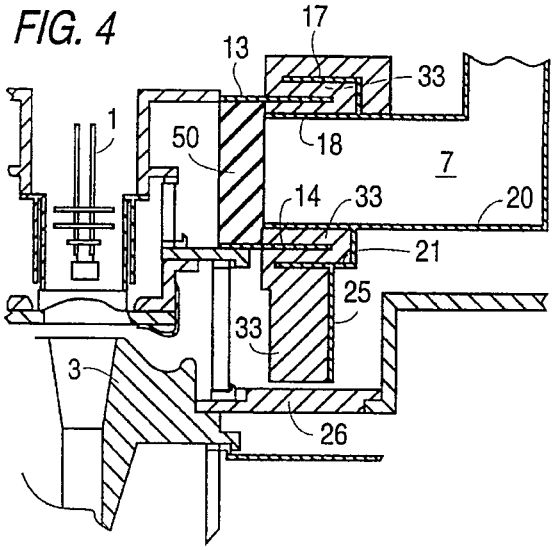
FIG. 4 schematically shows an IOT wherein ferrite loaded silicone rubber extends between r.f. chokes.

FIG. 4 illustrates an alternative arrangement in which ferrite loaded silicone rubber 33 is extensive between the support 26 of the anode 3 and the plate 21 and also is located between the co-extensive parts of both r.f. chokes defined by plates 13, 17, 18 and 14, 20, 21. In this embodiment, the inner surface of the ferrite loaded silicone rubber 33 is undulating. Also, a dielectric material 50 is interposed between plates 13 and 14.

Figure 5:
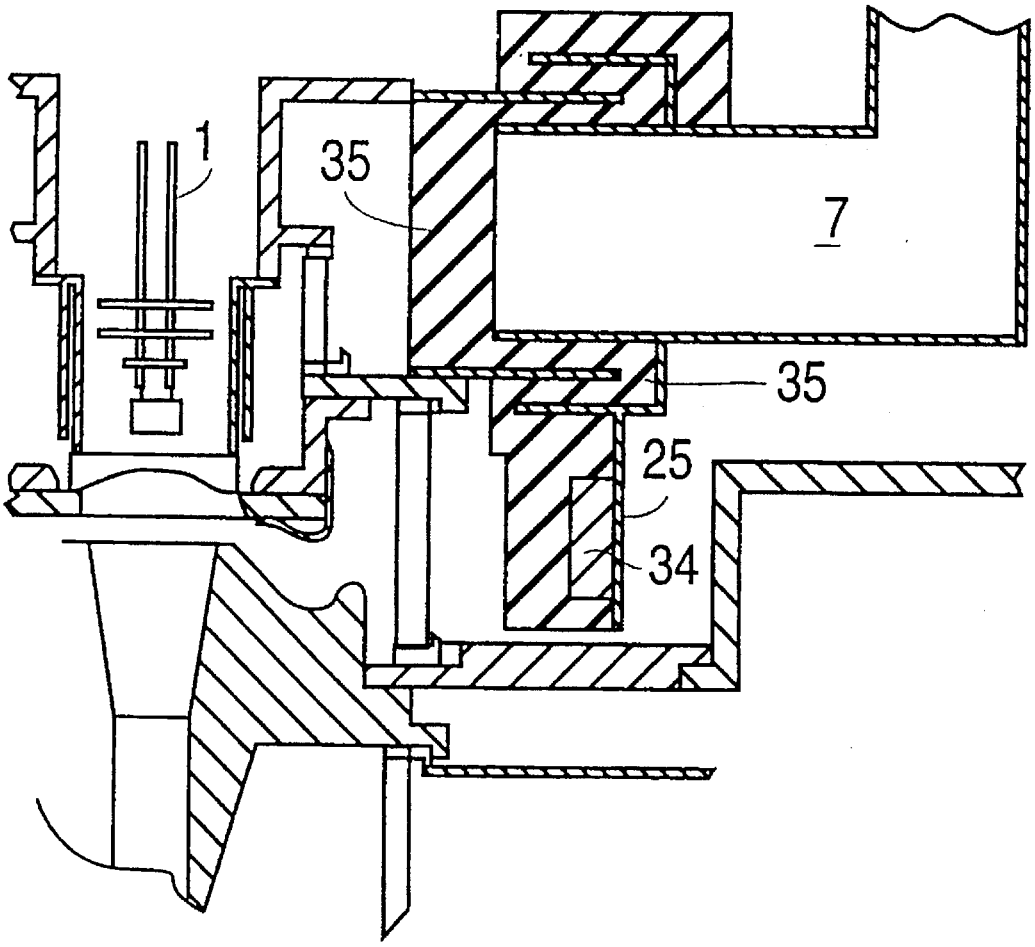
FIG. 5 schematically shows an IOT wherein a ring of ferrite loaded silicone rubber is carried directly by a cylindrical wall and surrounded by a resin.

FIG. 5 shows an arrangement in which a cylindrical ring of ferrite loaded silicone rubber 34 is carried directly by the inner surface of cavity wall 25 and is surrounded by resin 35. The cavity wall 25 covers the boundary between the two materials to reduce the tendency for arcing to occur. The resin 35 could be replaced by unloaded rubber or some other insulating material. Other configurations in accordance with the invention in which absorbing material is located adjacent other insulating materials may also include shielding means, not necessarily provided by the cavity wall, over otherwise exposed boundaries between them.

We claim:

1. An electron beam tube, having a longitudinal axis, comprising:

an electron gun assembly extending along said longitudinal axis;

a wall member defining a substantially annular high frequency resonant input cavity surrounding in part said electron gun assembly and extending in a direction coaxial with said longitudinal axis;

a layer of electrically insulating material affixed to said wall member; and an absorbing material capable of absorbing high frequency energy affixed to said electrically insulating material.

2. A tube as claimed in claim 1 wherein said electron gun assembly includes a cathode and an anode, and wherein said absorbing material is capable of withstanding a dc voltage difference applied between said cathode and anode on the order of tens of kilovolts.

3. A tube as claimed in claim 1 wherein said absorbing material is a ferrite loaded dielectric material.

4. A tube as claimed in claim 3 wherein the dielectric material is silicone rubber.

5. A tube as claimed in claim 1 wherein said wall member is substantially cylindrical and has an inside surface, and wherein said absorbing material is substantially circumferentially distributed around the inside surface of said wall member.

6. A tube as claimed in claim 1 wherein said electron gun assembly includes a cathode, an anode and a grid interposed between said cathode and anode, and wherein said absorbing material extends along said longitudinal axis between said grid and anode.

7. A tube as claimed in claim 1 including a vacuum envelope having an inside and an outside, said electron gun assembly being located adjacent the inside of said envelope and said absorbing material being located adjacent the outside of said envelope.

8. A tube as claimed in claim 1 wherein surfaces of said absorbing material are undulating.

9. An electron beam tube, having a longitudinal axis, comprising:

an electron gun assembly extending along said longitudinal axis;

a wall member defining a substantially annular high frequency resonant input cavity surrounding in part said electron gun assembly and extending in a direction coaxial with said longitudinal axis;

electrically insulating material affixed to said wall member; and an absorbing material capable of absorbing high frequency energy located adjacent said electrically insulating material to define a boundary therebetween, a portion of said absorbing material being affixed to said wall member, the boundary between said absorbing material and said electrically insulating material extending over an entire surface of said absorbing material except for the portion affixed to said wall member, said wall member acting as a shield thereby reducing the probability of arcing within said tube.

10. A tube as claimed in claim 9 wherein said absorbing material is a cylindrical shaped ring comprised of ferrite loaded silicone rubber.

11. An electron beam tube, having a longitudinal axis, comprising:

an electron gun assembly extending along said longitudinal axis;

a wall member defining a substantially annular high frequency resonant input cavity surrounding in part said electron gun assembly and extending in a direction coaxial with said longitudinal axis;

electrically insulating material affixed to said wall member, said electrically insulating material being selected from the group consisting of resin and unloaded rubber; and an absorbing material capable of absorbing high frequency energy located adjacent said electrically insulating material to define a boundary therebetween.

12. An electron beam tube, having a longitudinal axis, comprising:

an electron gun assembly extending along said longitudinal axis;

a wall member defining a substantially annular high frequency resonant input cavity surrounding in part said electron gun assembly and extending in a direction coaxial with said longitudinal axis;

an r.f. choke having interleaved electrically separate members located within an outer portion of said input cavity; and an absorbing material capable of absorbing high frequency energy located within the outer portion of said input cavity including between the interleaved members of said r.f. choke, said absorbing material reducing leakage from said input cavity.

13. A tube as claimed in claim 12 wherein said absorbing material is ferrite loaded silicone rubber.

14. A tube as claimed in claim 13 wherein said absorbing material has an inner surface facing said electron gun, said inner surface having an undulating shape.

* * * * *